US011284651B2

(12) United States Patent
Parkinson

(10) Patent No.: US 11,284,651 B2
(45) Date of Patent: Mar. 29, 2022

(54) ENGINEERED SURFACE FOR INCREASED DRAG ON ARTICLE

(71) Applicant: NIKE, Inc., Beaverton, OR (US)

(72) Inventor: Adam Parkinson, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 200 days.

(21) Appl. No.: 15/402,873

(22) Filed: Jan. 10, 2017

(65) Prior Publication Data

US 2017/0196285 A1 Jul. 13, 2017

Related U.S. Application Data

(60) Provisional application No. 62/277,296, filed on Jan. 11, 2016.

(51) Int. Cl.
*A63B 21/00* (2006.01)
*A41D 13/00* (2006.01)
(Continued)

(52) U.S. Cl.
CPC ..... *A41D 13/0015* (2013.01); *A41D 13/00* (2013.01); *A41D 27/10* (2013.01); *A41D 31/00* (2013.01); *A63B 21/0085* (2013.01); *A63B 21/0088* (2013.01); *A63B 21/4005* (2015.10); *A63B 21/4007* (2015.10);
(Continued)

(58) Field of Classification Search
CPC ..... A41D 27/10; A41D 31/00; A41D 13/00; A41D 13/0015; A63B 21/4025; A63B 21/0085; A63B 21/0088; A63B 21/4005; A63B 21/4017; A63B 21/4007;
(Continued)

(56) References Cited

U.S. PATENT DOCUMENTS 338,475 A * 3/1886 Buchanan ..... A45C 3/06 150/127
1,128,682 A 2/1915 Homewood et al.
(Continued)

FOREIGN PATENT DOCUMENTS

CN 2676960 Y 2/2005
CN 202237018 U 5/2012
(Continued)

OTHER PUBLICATIONS

International Search Report and Written Opinion dated May 3, 2017 for International Patent Application No. PCT/US2017/012983, 14 pages.
(Continued)

*Primary Examiner* — Katharine G Kane
(74) *Attorney, Agent, or Firm* — Shook Hardy & Bacon, L.L.P.

(57) ABSTRACT

An article having a panel and a trim piece. The panel may have at least a first panel edge, an outer surface, and a plurality of integrally-formed flaps that extend from the outer surface. The trim piece may be affixed to the panel proximate the first panel edge and may secure an end portion of at least one of the plurality of integrally-formed flaps between the trim piece and the outer surface of the panel. A plurality of panels may form, or be secured to, a garment in different orientations. Each of the plurality of panels may be separated by one or more trim pieces.

14 Claims, 10 Drawing Sheets

(51) Int. Cl.
*A63B 21/008* (2006.01)
*A41D 27/10* (2006.01)
*A41D 31/00* (2019.01)

(52) U.S. Cl.
CPC ..... *A63B 21/4009* (2015.10); *A63B 21/4011* (2015.10); *A63B 21/4017* (2015.10); *A63B 21/4025* (2015.10)

(58) Field of Classification Search
CPC ... A63B 21/4009; A63B 21/4011; A45C 3/00; A45C 3/06
See application file for complete search history.

(56) References Cited

U.S. PATENT DOCUMENTS 1,178,165 A * 4/1916 Lupton, Jr. ..... B64C 33/00 114/102.11
1,458,624 A * 6/1923 Macdaid ..... A41G 1/04 112/400
2,259,560 A * 10/1941 Glidden ..... A41D 27/28 428/134
2,435,784 A * 2/1948 Hoffmann ..... A45C 13/083 150/129
2,727,548 A * 12/1955 Kasdan ..... A45C 3/06 150/107
4,067,278 A * 1/1978 Davis ..... D05C 17/00 112/429
4,071,236 A 1/1978 Oprean
4,074,904 A 2/1978 Arcidiacono
4,220,299 A * 9/1980 Motter ..... B64D 10/00 2/250
4,443,506 A * 4/1984 Schmolmann ..... F41H 1/02 428/102
4,527,794 A 7/1985 Dunn
4,665,851 A * 5/1987 Sweet ..... A41D 31/02 112/409
4,734,072 A * 3/1988 Lastnik ..... B64D 10/00 441/105
4,854,572 A 8/1989 Knight et al.
RE33,215 E * 5/1990 Sweet ..... A41D 27/08 112/409
5,001,782 A * 3/1991 Stewart ..... A41D 27/08 2/244
5,133,516 A * 7/1992 Marentic ..... B05D 5/02 244/130
5,176,600 A * 1/1993 Wilkinson ..... A41D 13/0015 482/105
5,269,862 A * 12/1993 Nakajima ..... A01G 9/1438 156/155
5,274,848 A * 1/1994 Shamblin ..... A41D 13/00 2/69
5,347,659 A * 9/1994 Tibljas ..... A41D 13/00 2/1
5,380,578 A 1/1995 Rautenberg
5,412,813 A 5/1995 Hosley
5,487,710 A * 1/1996 Lavorgna ..... A41D 7/00 2/67
5,819,315 A * 10/1998 Ruffa ..... A41D 13/0015 2/69
5,887,280 A 3/1999 Waring et al.
5,890,225 A * 4/1999 Marschall ..... A41D 13/0002 2/247
5,960,474 A 10/1999 Dicker et al.
6,047,406 A 4/2000 Dicker et al.
6,098,198 A 8/2000 Jacobs et al.
6,195,801 B1 3/2001 Meyers
6,279,161 B1 * 8/2001 Johnston ..... A41D 13/0015 2/115
6,305,031 B1 * 10/2001 White ..... A41D 13/0153 128/882
6,423,165 B1 * 7/2002 Hishinuma ..... A41D 27/08 112/117
6,499,142 B1 * 12/2002 Lee ..... A41D 1/18 2/106
6,910,223 B2 * 6/2005 Egnew ..... A41D 13/00 2/69
7,094,217 B2 * 8/2006 Fialkoff ..... A41C 3/04 450/36
7,117,538 B2 * 10/2006 Bosne ..... A41D 3/00 2/93
7,856,668 B2 * 12/2010 Demarest ..... A41D 7/00 2/69
8,336,117 B2 * 12/2012 Carter ..... A41D 31/102 2/87
8,341,765 B2 * 1/2013 Brodbeck ..... A41D 7/00 2/67
9,072,324 B2 * 7/2015 Zamponi ..... A41D 13/00
2003/0217406 A1 * 11/2003 Shultz ..... A41D 13/00 2/244
2004/0221362 A1 * 11/2004 Bosne ..... A41D 3/00 2/93
2005/0108800 A1 * 5/2005 White ..... A41D 13/0153 2/2.5
2006/0107437 A1 * 5/2006 Griesbach ..... A41D 13/1209 2/114
2007/0271668 A1 * 11/2007 Pape ..... A41D 13/0015 2/69
2008/0078008 A1 * 4/2008 Demarest ..... A41D 7/00 2/115
2008/0134419 A1 * 6/2008 Kalaam ..... A41D 13/00 2/463
2010/0037369 A1 * 2/2010 Reichert ..... A61F 13/06 2/228
2010/0144490 A1 6/2010 Purdy et al.
2012/0079639 A1 * 4/2012 Hughes ..... A41D 13/043 2/2.5
2012/0131720 A1 * 5/2012 Nordstrom ..... A41D 13/0015 2/69
2012/0324613 A1 12/2012 Tsang et al.
2013/0254967 A1 10/2013 Tiemann
2013/0276201 A1 * 10/2013 Pezzimenti ..... A41D 27/245 2/69
2013/0298302 A1 11/2013 Whaley
2017/0340037 A1 * 11/2017 Bailey ..... A41D 27/285

FOREIGN PATENT DOCUMENTS

DE 10211083846 A1 * 4/2013 ..... A41D 27/00
FR 2761859 A1 * 10/1998 ..... A41D 13/0015
JP 2013-24424 A 2/2013
KR 19940008979 B1 9/1994
WO 0045656 A3 8/2000
WO 0045658 A1 8/2000
WO WO-2006058939 A1 * 6/2006 ..... A41D 13/0015

OTHER PUBLICATIONS

"Durable Hot!!! New Arrival Speed Training Resistance Running Power Chute Exercise Parachute Fast Shipping." Ali Express, aliexpress.com, © 2015, accessed: Aug. 20, 2015. http://www.aliexpress.com/item/Durable-Hot-New-Arrival-Speed-Training-Resistance-Running-Power-Chute-Exercise-Parachute-Fast-Shipping/32356718530.html.
"Finis Ultimate Drag Suit." Swim Outlet, swimoutlet.com, SKU: 1.20.007.101, Product Code: 18907, © 2015, accessed: Aug. 20, 2015. http://www.swimoutlet.com/p/finis-ultimate-drag-suit-18907/.
Examination report dated Dec. 18, 2019 in Sri Lanka Patent Application No. 19959, 1 page.
Examination Report dated May 1, 2019 in Canadian Patent Application No. 3,010,911, 5 pages.
Notice of Allowance received for Canadian Patent Application No. 3010911, dated Apr. 27, 2020, 1 page.
Intention to Grant received for European Patent Application No. 17701249.9, dated Jul. 21, 2020, 8 pages.

* cited by examiner

ENGINEERED SURFACE FOR INCREASED DRAG ON ARTICLE

CROSS-REFERENCE TO RELATED APPLICATIONS

This application claims priority to U.S. Provisional Application No. 62/277,296, filed Jan. 11, 2016, titled "Engineered Surface for Increased Drag on Article," the entire contents of which are hereby incorporated by reference.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The present invention is defined by the claims.

At a high level, aspects herein are directed to an article having at least one panel with a plurality of integrally-formed flaps extending from an outer surface of the panel and at least one trim piece securing an end portion of at least one of the integrally-formed flaps to the outer surface of the panel proximate to a first panel edge to form one or more air pockets. In exemplary aspects, the one or more air pockets are configured to capture air between one or more pairs of adjacent flaps for creating drag between the one or more pairs of adjacent flaps. When moved through fluid, such as air, the one or more air pockets increase the air resistance to locomotion of the wearer. In other words, the one or more air pockets induce drag on the article, and thus on the wearer when the article is in an as-worn position. Thus, when used as a training accessory, the apparel item described herein may cause the wearer to exert greater effort during training with improved performance benefits when competing. Moreover, the one or more drag pockets are integrated into the apparel item in such a way as to not interfere with the wearer's cadence or form.

Further aspects herein are directed to a garment for inducing drag on a wearer of the garment. In aspects herein described, the garment may comprise an upper torso apparel item for an upper torso of the wearer, a lower torso apparel item for a lower torso of the wearer, and/or a sleeve for a limb of the wearer. For instance, when the garment is configured as the upper torso apparel item, the upper torso apparel item may be in the form of a vest or shirt. The garment may include one or more drag inducing articles, such as the above described article. The garment may further comprise additional panels affixed to the one or more drag inducing articles to form the garment. Overlapping flaps formed integral to the panel of the drag inducing article may be oriented on the outer surface of the garment to provide a maximum increase in air resistance for a particular activity based upon the anticipated direction of movement. For example, when the wearer will be sprinting and rises from a crouched position to a standing position to begin rapid ground locomotion, the flaps extending from the panel may extend longitudinally around a portion of the torso of the wearer such that ambient air is captured in the air pockets as the wearer rises. When moving through the air, the air pockets increase the drag on the garment and thereby cause the wearer to expend greater effort when moving (i.e., when rising from the crouched position, or running in ground locomotion, or otherwise engaging in movement through a fluid).

Another aspect herein is directed to a method of manufacturing an article for providing fluid resistance when the article is moved through a fluid. The method may comprise providing a panel having at least a first panel edge, an outer surface, and a plurality of integrally-formed flaps extending from the outer surface of the panel. In some aspects, the plurality of integrally-formed flaps further comprises a first end portion located proximate to the first panel edge. The method may further comprise providing a first trim piece and securing the first end portion of at least one of the plurality integrally-formed flaps between the outer surface of the panel and the first trim piece proximate to the first panel edge.

In some aspects, the method may further comprise providing a second trim piece and securing a second end portion of at least one of the integrally-formed flaps between the outer surface of the panel and the second trim piece proximate to the second panel edge.

The apparel items described herein (e.g., shirts, vests, jackets, sleeves, pants, and shorts) may be worn by themselves or in combination to provide varying levels of air resistance. For instance, the vest or pants described herein may be worn with the sleeve described herein to provide an increased level of air resistance as compared to the vest or pants being worn without the sleeve or the sleeve being worn without the vest or pants.

BRIEF DESCRIPTION OF THE DRAWINGS

Examples of the present invention are described in detail below with reference to the attached drawing figures, wherein.

DETAILED DESCRIPTION

Figure 1:
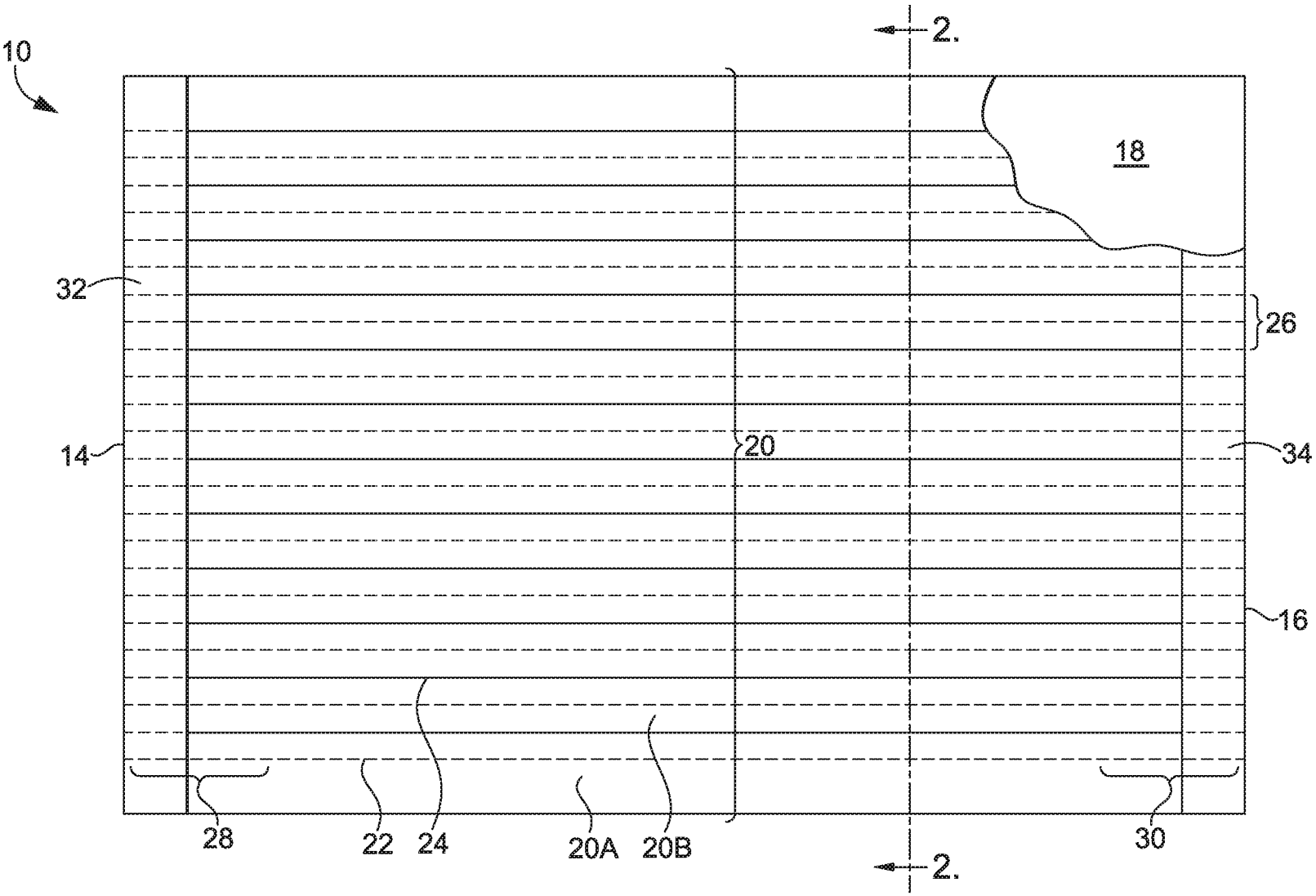
FIG. 1 illustrates a top view of an exemplary article having the air pocket structure in accordance with aspects herein.

The subject matter of the present invention is described with specificity herein to meet statutory requirements. However, the description itself is not intended to limit the scope of this patent. Rather, the inventors have contemplated that the claimed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

Throughout this description, the term "as-worn position" will be used when discussing the orientation of the disclosed article of apparel. The as-worn position of the article of apparel denotes the position the article of apparel is in when donned by a wearer. Hence, in the as-worn position, an upper-body garment, such as a shirt, will be oriented such that a neck opening will be at the top of the shirt and near the upper end of the wearer's torso. Similarly, in the as-worn position, a lower-body garment, such as a pair of pants, will be oriented such that a waist opening will be at the top of the pants and near the waist of the wearer.

Further, the term "affixing" or "coupling" may comprise releasably affixing two items together via, for instance, buttons, snaps, zippers, hook-and-loop fasteners, and the like, and may also comprise permanently affixing two items together via, for example, stitching, bonding, adhesives, welding, and the like. Any and all aspects, and any variation thereof, are contemplated as being within the scope herein.

Aspects herein are directed to an article configured to induce increased drag as the article is moved through a fluid. Throughout this description, the fluid used for exemplary purposes is air. This description applies equally, however, to any fluid, such as water or any other liquid or gas.

At a high level, aspects herein are directed to an article having a panel with integrally-formed flaps extending from an outer surface of the panel and at least one trim piece securing an end portion of at least one of the integrally-formed flaps to the outer surface proximate to a first panel edge to form one or more drag pockets between one or more pairs of adjacent flaps. Referring initially to FIGS. 1-4, some aspects are directed to an article 10 comprised of a panel 12 having a first panel edge 14 and a second panel edge 16. The first panel edge 14 may be opposite the second panel edge 16. The panel 12 also has an outer surface 18 from which the integrally-formed flaps 20 may extend. The panel 12 may be comprised of a knit fabric, a woven fabric, or any other suitable material.

Each of the integrally-formed flaps 20 may comprise a first flap edge 22 that extends across at least a portion of the outer surface 18 of the panel 12 and that extends out from the outer surface 18 to a second flap edge 24. As such, in these aspects, the first flap edge 22 is in direct contact with the outer surface 18 of the panel 12. In some aspects, the first flap edge 22 may extend across the outer surface 18 from the first panel edge 14 to the second panel edge 16. In other aspects, the first flap edge 22 extends only across a portion of the outer surface 18.

The first flap edge 22 of each of the integrally-formed flaps 20 may be offset from other first flap edges 22, such as by a predetermined length. In some aspects, the first flap edge 22 of at least some of the integrally-formed flaps 20 may extend across the outer surface 18 of the panel 12 in parallel with the first flap edge 22 of other integrally-formed flaps. In these aspects, some or all of the integrally-formed flaps may have first flap edges that are parallel with other first flap edges, but some may not be parallel to others. In other aspects, the first flap edge 22 of some or all of the integrally-formed flaps 20 may be concentrically aligned with the first flap edge 22 of the other integrally-formed flaps, while some may not be concentrically aligned. In yet other aspects, the first flap edge 22 of some or all of the integrally-formed flaps 20 may extend across the outer surface 18 of the panel 12 in parallel with the first flap edge 22 of other integrally-formed flaps and each of the first flap edges 22 may be offset an offset distance 26 from other first flap edges 22.

The first flap edge 22 may comprise the most proximal portion of each of the integrally-formed flaps 20. In other words, the first flap edge 22 may comprise the segment across which each of the integrally-formed flaps 20 are joined to the panel 12.

Each of the integrally-formed flaps 20 may further comprise a first end portion 28 and a second end portion 30. In the illustrated aspect, the first end portion 28 is opposite the second end portion 30. In other aspects, the end portions are not opposite each other.

The article 10 may further comprise a first trim piece 32 affixed proximate to the first panel edge 14. The first trim piece 32 may secure the first end portion 28 of at least one of the integrally-formed flaps 20 between the first trim piece 32 and the outer surface 18 of the panel 12. In some aspects, the article 10 may further comprise a second trim piece 34 affixed proximate to the second panel edge 16. The second trim piece 34 may secure the second end portion 30 between the second trim piece 34 and the outer surface 18 of the panel 12.

In some aspects, the panel 12 may include one or more panel edges that extend between the first panel edge 14 and the second panel edge 16. Each of the one or more panel edges may extend from the first panel edge 14 to the second panel edge 16, may extend from one of the first panel edge 14 and the second panel edge 16 to an intermediate point of intersection, or may extend between a pair of the intermediate points of intersection. It is understood that the panel 12 may be formed into any shape that is suitable for the intended use of the article 10. The article 10 may further comprise one or more trim pieces affixed proximately to the one or more panel edges. The one or more trim pieces may secure a portion of at least one of the integrally-formed flaps 20 between the one or more trim pieces and the outer surface 18 of the panel 12. In other aspects, the first trim piece 32, the second trim piece 34, and the one or more trim pieces may comprise portions of a unitary trim piece that is configured to be affixed around the perimeter of the article 10.

When secured between one or more of the trim pieces, the integrally-formed flaps 20 may fold over in a direction generally normal to the direction the first flap edge 22 extends across the outer surface 18 of the panel 12. In aspects, the integrally-formed flaps 20 are folded over in a first direction. The first direction may be opposite of the direction of anticipated movement of the article 10. The first direction may also be opposite of the direction of desired drag force. In some aspects, the first direction is not opposite of the direction of anticipated movement of the article 10, but includes a vector component that is opposite of the direction of anticipated movement of the article 10 and a vector component that is normal to the direction of anticipated movement of the article 10.

The first trim piece 32 may secure at least one of the integrally-formed flaps 20 in the folded over position such that the at least one of the integrally-formed flaps 20 lies substantially parallel to the outer surface 18 of the panel 12 at the first end portion 28. In aspects, the second trim piece 34 may secure at least one of the integrally-formed flaps 20 in the folded over position such that the at least one of the integrally-formed flaps 20 lies substantially parallel to the outer surface 18 of the panel 12 at the second end portion 30. The illustrated aspect depicts both the first trim piece 32 and the second trim piece 34 securing the first end portion 28 and the second end portion 30, respectively, of each of the integrally-formed flaps 20 folded over in the same direction. It is contemplated, however, that the first trim piece 32 and the second trim piece 34 may secure the integrally-formed flaps 20 folded over in opposite directions.

In some aspects, the offset distance 26 may be less than the distance the integrally-formed flaps 20 extend from the first flap edge 22 to the second flap edge 24. Consequently, the second flap edge 24 of one of the integrally-formed flaps 20 may overlap another of the integrally-formed flaps 20. A pair of adjacent flaps 36 of the integrally-formed flaps 20 may include, for example, a first flap 20A and a second flap 20B and, in aspects, the second flap edge 24 of the first flap 20A may overlap the first flap edge 22 of the second flap 20B.

Each trim piece may comprise a strip of fabric, a tape (such as a zipper tape), an edge of an adjacent panel, or any other material suitable for securing at least one of the end portions of the integrally-formed flaps 20 between said trim piece and the outer surface 18 of the panel 12. In some aspects, the first trim piece 32 may be affixed to the panel 12 proximate to the first panel edge 14 such that the first trim piece 32 is positioned over the outer surface 18 side of the panel 12. In other aspects, the first trim piece 32 may be affixed to the panel 12 along the first panel edge 14 such that the first trim piece 32 wraps around the first panel edge 14 leaving a portion of the first trim piece 32 affixed over the outer surface 18 and a portion of the first trim piece 32 affixed beneath the outer surface 18. In yet other aspects, where a second panel (see FIG. 5 for example) is affixed adjacent to the panel 12 at a seam, the first trim piece 32 may be affixed proximate to the first panel edge 14 of the panel 12 and a first panel edge of the second panel, across the seam, and over the outer surface 18 of each of the panels. In yet still other aspects, the first trim piece 32 comprises a seam adjacently affixing the panel 12 to the second panel.

It is contemplated that, in some aspects, the integrally-formed flaps 20 may be secured at one or both of the first end portion 28 and the second end portion 30 to the outer surface of the panel 12 by a means other than the first trim piece 32 and second trim piece 34. For example, in some aspects, the first end portion 28 may be stitched to the panel 12 proximate to the first panel edge 14. In other aspects, the first end portion 28 may be bonded to the panel 12 proximate to the first panel edge 14. In still other aspects, the second end portion 30 may be affixed, releasably or permanently, to the panel 12 proximate to the second panel edge 16.

One or more air pockets 38 for creating drag may be formed on the article 10 by the folding over of the integrally-formed flaps 20 and the securing of at least one of the end portions between at least one of the trim pieces and the outer surface 18 of the panel 12. The one or more air pockets 38 may each be formed between one or more pairs of adjacent flaps 36. For example, referring to FIG. 4, an exemplary air pocket 38 is depicted in part. The exemplary air pocket 38 is formed between the first flap 20A and the second flap 20B and is bounded in part by the first end portion 28 and the outer surface 18.

The one or more air pockets 38 may capture air moving across, and proximately to, the outer surface 18 of the panel 12. Similarly, the one or more air pockets 38 may also capture ambient air through which the article 10 moves. For example, when the article 10 moves in direction A (shown in FIG. 3) the one or more air pockets 38 (shown in FIG. 4) may capture air through which the article 10 moves. The air captured by the one or more air pockets 38 imparts a drag force on the article 10. The drag force imparted may cause the wearer to exert greater effort during training with improved performance benefits when competing. In essence, the wearer may don a garment comprising one or more articles 10 while training without interrupting their natural cadence or form. Such training may improve the wearer's performance when competing because the wearer will not need to overcome the additional resistance imparted from the article 10.

Figure 2:
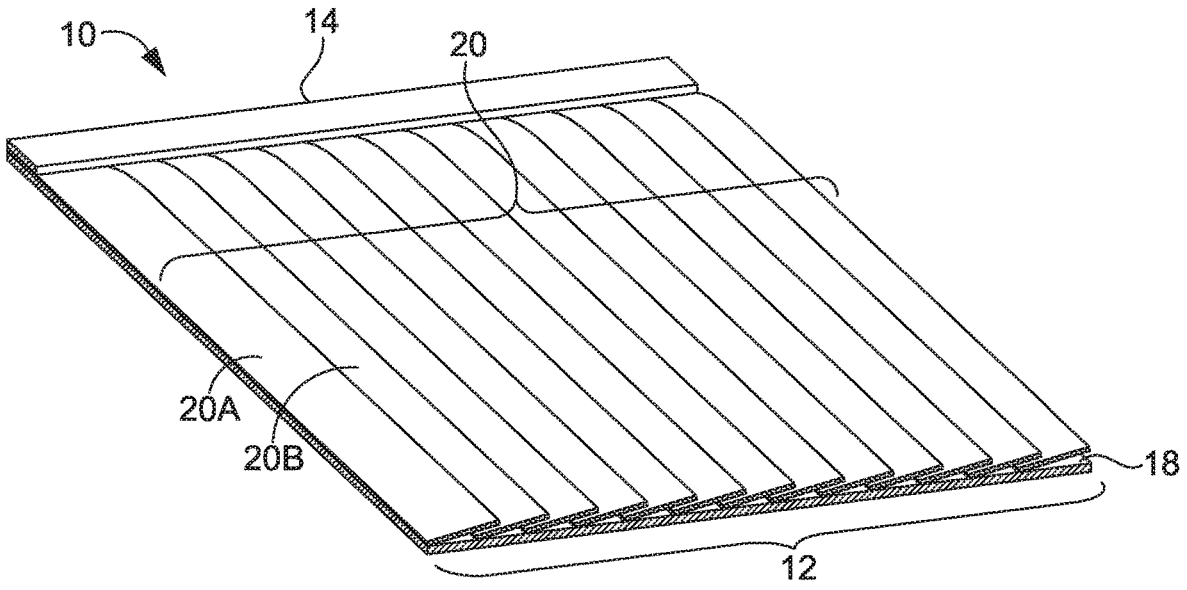
FIG. 2 illustrates a cross-sectional view taken along cut line 2-2 of FIG. 1 and depicts the exemplary article having the air pocket structure of FIG. 1 where the article presents a closed position in accordance with aspects herein.
Figure 3:
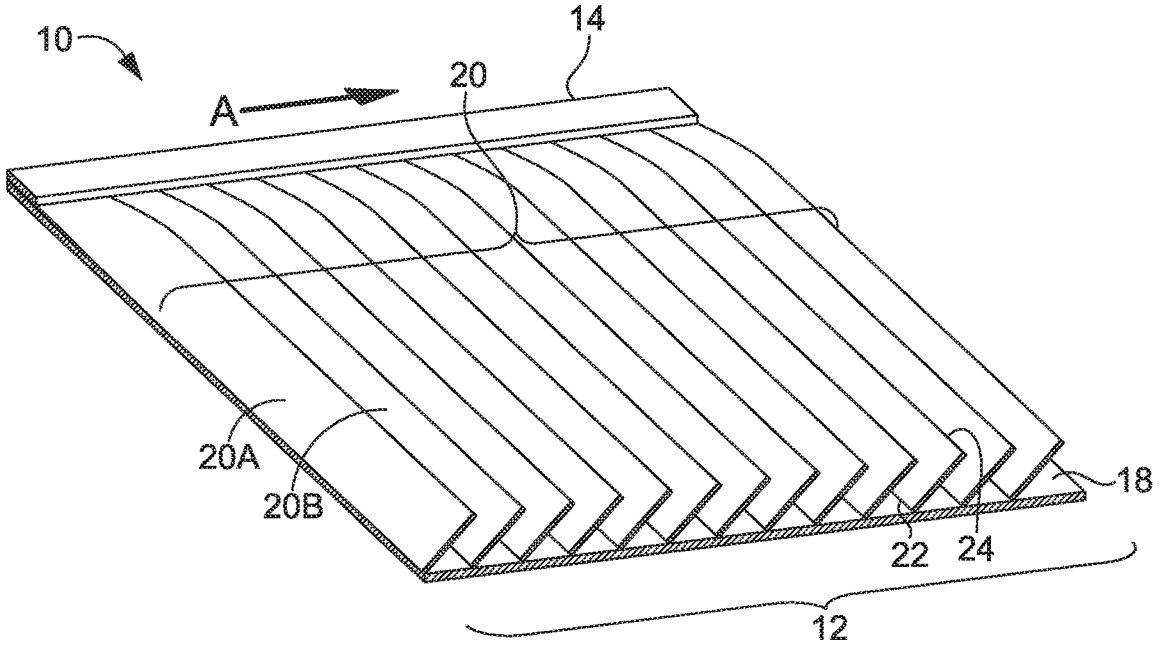
FIG. 3 illustrates a cross-sectional view taken along cut line 2-2 of FIG. 1 and depicts the exemplary article having the air pocket structure of FIG. 1 where the article presents an open position in accordance with aspects herein.
Figure 4:
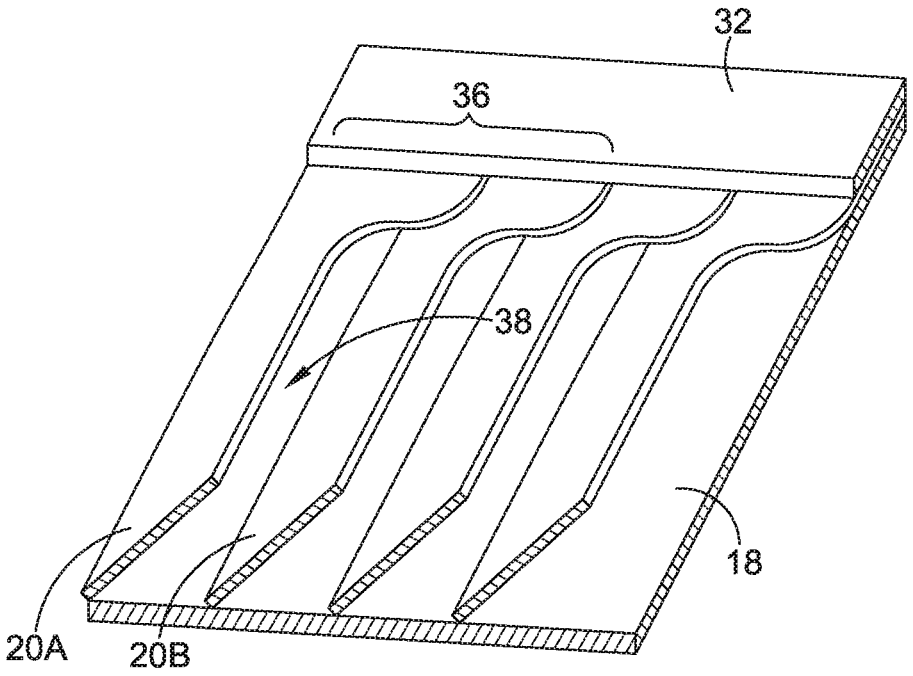
FIG. 4 illustrates a close-up view of the air pocket structure in accordance with aspects herein.

The panel 12 may be comprised of a flexible material or a rigid material. Similarly, the integrally-formed flaps 20 may be secured by the one or more trim pieces under tension or without tension. In some aspects, the article 10 may appear to have a substantially closed position when the integrally-formed flaps 20 lay substantially flat against the panel 12 (e.g., such as when the panel is not moving against a flow of fluid). One example of the integrally-formed flaps 20 being in a substantially closed position is depicted in FIG. 2. In other aspects, the article 10 may appear to not be flat, such as when the integrally-formed flaps are in a substantially open position where the integrally-formed flaps 20 tilt away from the panel 12. One example of the integrally-formed flaps 20 being in a substantially open position is depicted in FIG. 3. The substantially open position may be characterized by the one or more air pockets 38, such as the air pockets 38 illustrated in FIG. 4, presenting an increased cross-sectional area for capturing the air through which the article 10 passes.

In aspects where the panel 12 is comprised of the flexible material, the article 10 may present the closed position until movement commences. Upon movement of the article 10 commencing, the captured air may begin imparting a drag force on the article 10 and the article 10 may present the open position until movement ceases. In aspects where the panel 12 is comprised of the rigid material, the article 10 may present the open position regardless of movement commencing or ceasing.

Further aspects herein are directed to a garment configured to create increased drag force on a wearer. The garment may comprise a panel 12 having the outer surface 18, at least the first panel edge 14, and the integrally-formed flaps 20. The integrally-formed flaps 20 may be positioned on the outer surface 18 of the panel 12. Each of the integrally-formed flaps 20 may comprise the first flap edge 22 along which the integrally-formed flaps 20 extend distally away from the outer surface 18 of the panel 12. Each first flap edge 22 may be offset from the other first flap edges 22. Each of the integrally-formed flaps 20 may overlap an adjacent flap of the integrally-formed flaps 20. The garment may further comprise the first trim piece 32 affixed to the panel 12 proximate to the first panel edge 14. The first trim piece 32 may secure the first end portion 28 of at least one of the integrally-formed flaps 20 between the first trim piece 32 and the outer surface 18. In some aspects, each of the integrally-formed flaps 20 are secured such that the overlapping occurs in the same direction across all of the panel 12. For example, each of the overlapping flaps 20 of drag inducing articles 42 (discussed below in reference to FIGS. 5-10) may be secured such that the overlapping occurs in the direction of reference arrows D (shown in FIGS. 5-10) across all of an individual drag inducing article 42. Thus, in this example, the offset lines of the drag inducing articles 42 are perpendicular to the reference arrows D and may represent the second flap edge 24 of each of the integrally-formed flaps 20.

As will be shown and described in further detail herein in relation to FIGS. 5-10, an article that is configured to be worn by a wearer could be in the form of a single panel having integrally-formed flaps thereon and a trim piece. This single panel could be added to a garment, such as an upper torso apparel item or a lower body apparel item. For instance, a panel having integrally-formed flaps could be somehow affixed to a vest, shirt, pants, shorts, etc., worn by a wearer for training purposes. In some instances, this single panel may not be permanently secured to the garment, but could be removably affixed so that it is worn only during training. As such, in these embodiments, the panel may be secured on top of a particular article or garment.

In some aspects, the panel having integrally-formed flaps as described herein may be affixed to at least one other panel, such as by a trim piece, to form an article or even a garment. For instance, as shown in FIGS. 5-10, which will be described in more detail herein, two separate panels may be affixed to one another based on the anticipated movement of a wearer. For example, a person's lower arm moves differently than the person's upper arm, such as when the person is running or otherwise moving. As such, a first panel may be used for a person's lower arm and a second panel may be used for a person's upper arm, where the integrally-formed flaps are positioned differently in the second panel than the first panel.

In yet additional aspects, one or more panels may be affixed to one another and/or affixed to other panels that do not have integrally-formed flaps. Panels that do not have integrally-formed flaps may be substantially planar when laid in a flat position. Taking a shirt for example, a front and/or side portions of the shirt may have panels comprising integrally-formed flaps to increase drag when the wearer is moving, but may have panels on the back portion of the shirt that do not have integrally-formed flaps, but rather may have a substantially smooth surface. A garment that can be worn, for instance, may comprise one or more panels comprising integrally-formed panels that may be affixed to other panels that do not have integrally-formed panels, such as to form an upper torso apparel item, a lower torso apparel item, or a combination thereof.

Figure 5:
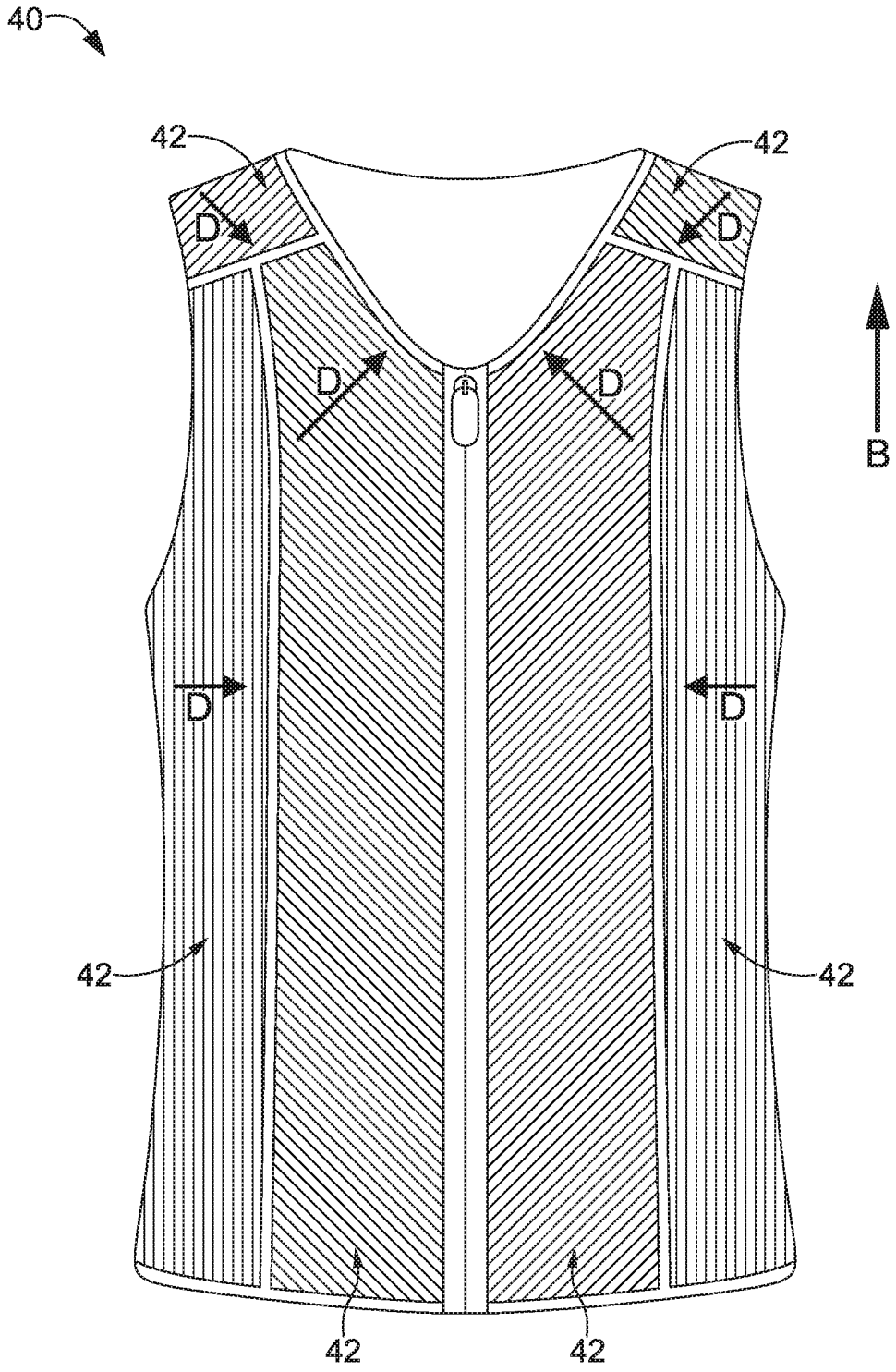
FIG. 5 illustrates a front elevation view of an exemplary garment comprising an upper body apparel item depicted in the as-worn position in accordance with aspects herein.
Figure 6:
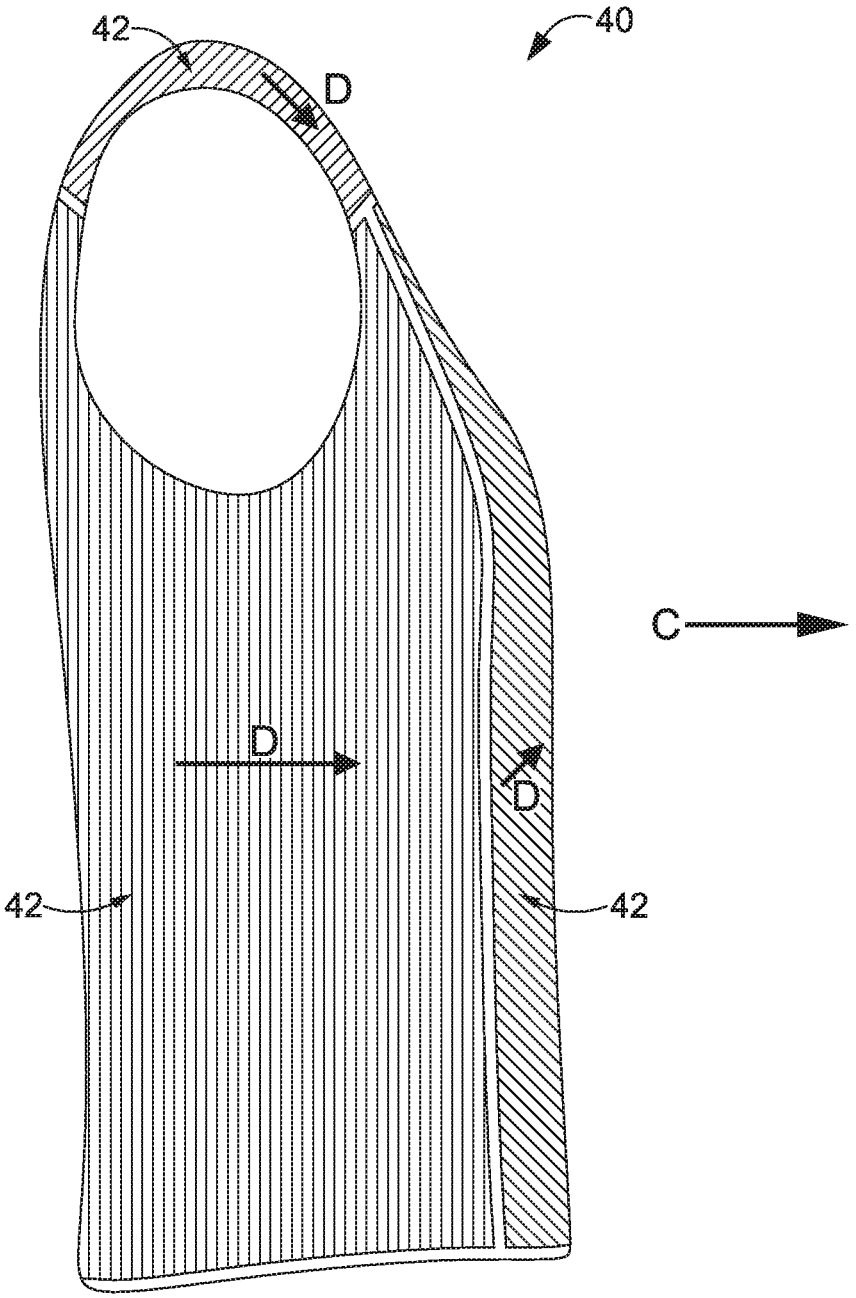
FIG. 6 illustrates a side elevation view of the exemplary garment comprising an upper body apparel item depicted in the as-worn position in accordance with aspects herein.

Referring to FIGS. 5 and 6, in some aspects, the garment may comprise an upper torso apparel item 40. The upper torso apparel item 40 may comprise a shirt, a vest, or other garment adapted to cover a portion of the upper torso of a wearer when the garment is in the as-worn position. The upper torso apparel item 40 may comprise the drag inducing articles 42. The upper torso apparel item 40 may further comprise the one or more additional panels 46 (not shown). As mentioned, these additional panels 46 (not shown) could comprise integrally-formed flaps to increase drag, or may not comprise integrally-formed flaps.

The drag inducing articles 42 may be oriented in different directions from one another to induce drag forces based on a plurality of wearer movements. For example, some of the drag inducing articles 42 may be oriented to provide increased drag when the upper torso apparel item 40 is moved in a first direction B. A wearer may move, and consequently cause the upper torso apparel item 40 to move when in the as-worn position, in the first direction B when moving from a crouched position to a standing position (for example, when a sprinter begins a sprint) or when moving from a standing position to a leaping position (for example, when a basketball player leaps in the air). Similarly, some of the drag inducing articles 42 may be oriented to provide increased drag when the upper torso apparel item 40 is moved in a second direction C. A wearer may move, and consequently cause the upper torso item 40 to move when in the as-worn position, in the second direction C when engaging in ground locomotion (e.g., when the wearer is running).

Figure 7:
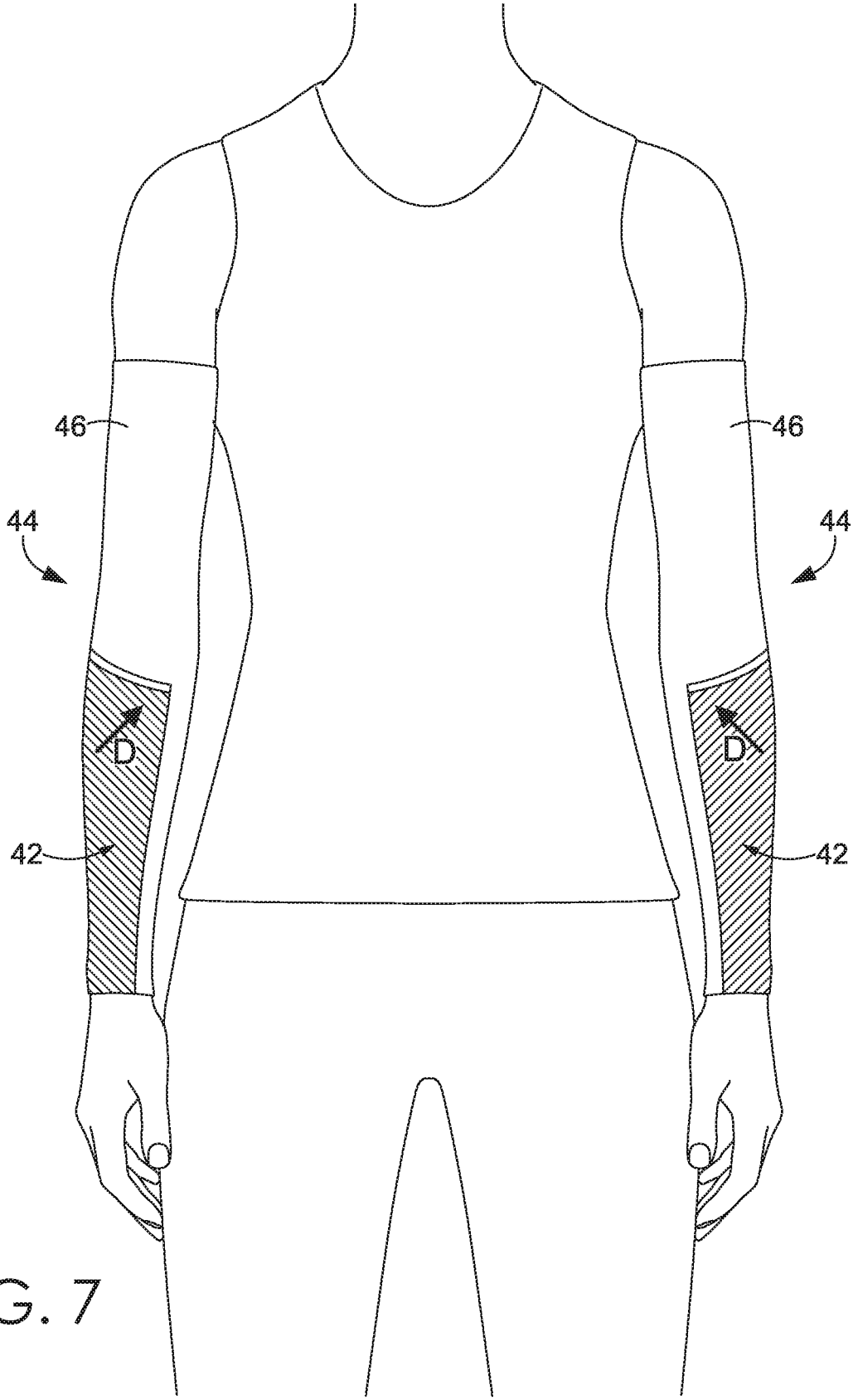
FIG. 7 illustrates a front elevation view of an exemplary garment comprising a sleeve depicted in the as-worn position in accordance with aspects herein.
Figure 8:
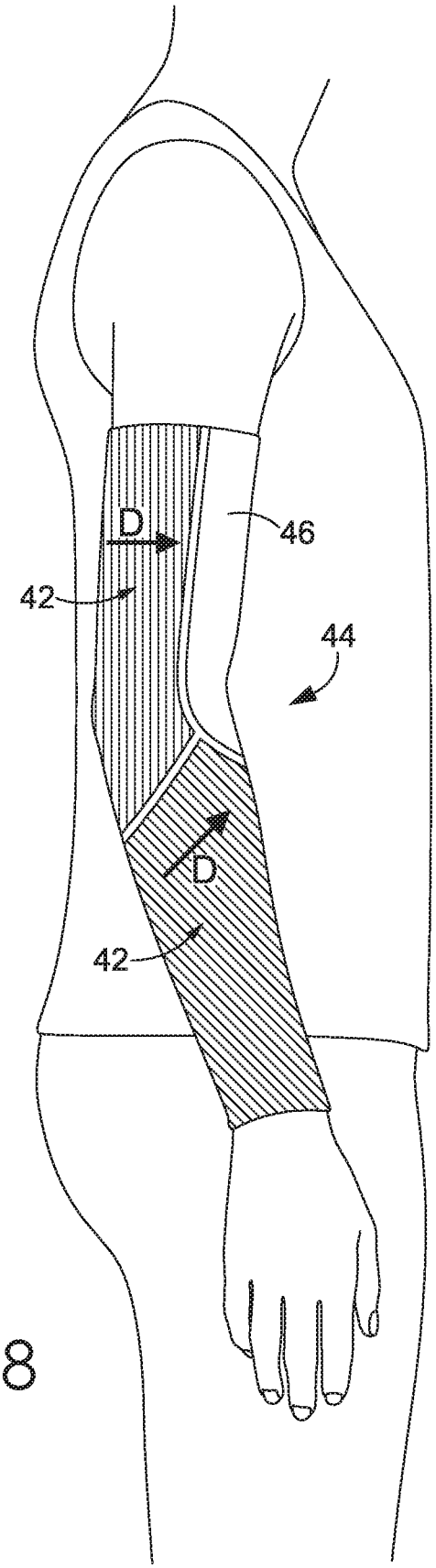
FIG. 8 illustrates a side elevation view of the exemplary garment comprising a sleeve depicted in the as-worn position in accordance with aspects herein.

Referring to FIGS. 7 and 8, in some aspects the garment may comprise a sleeve 44. The sleeve 44 may cover a portion of the arm or other limb of a wearer when the garment is in the as-worn position. The sleeve 44 may comprise the drag inducing articles 42. The sleeve 44 may further comprise one or more additional panels 46.

The drag inducing articles 42 may be oriented in different directions from one another to induce drag forces based on a plurality of wearer movements. For example, some of the drag inducing articles 42 may be oriented to provide increased drag when the sleeve 40 is moved based on rotation of the entire arm about the should joint (for example, during the downswing in a baseball, golf, or tennis swing). Similarly, other drag inducing articles 42 may be oriented to provide increased drag when the sleeve 40 is moved based on hinging of the lower arm about the elbow joint (for example, during the follow-through in a golf or tennis swing).

Figure 9:
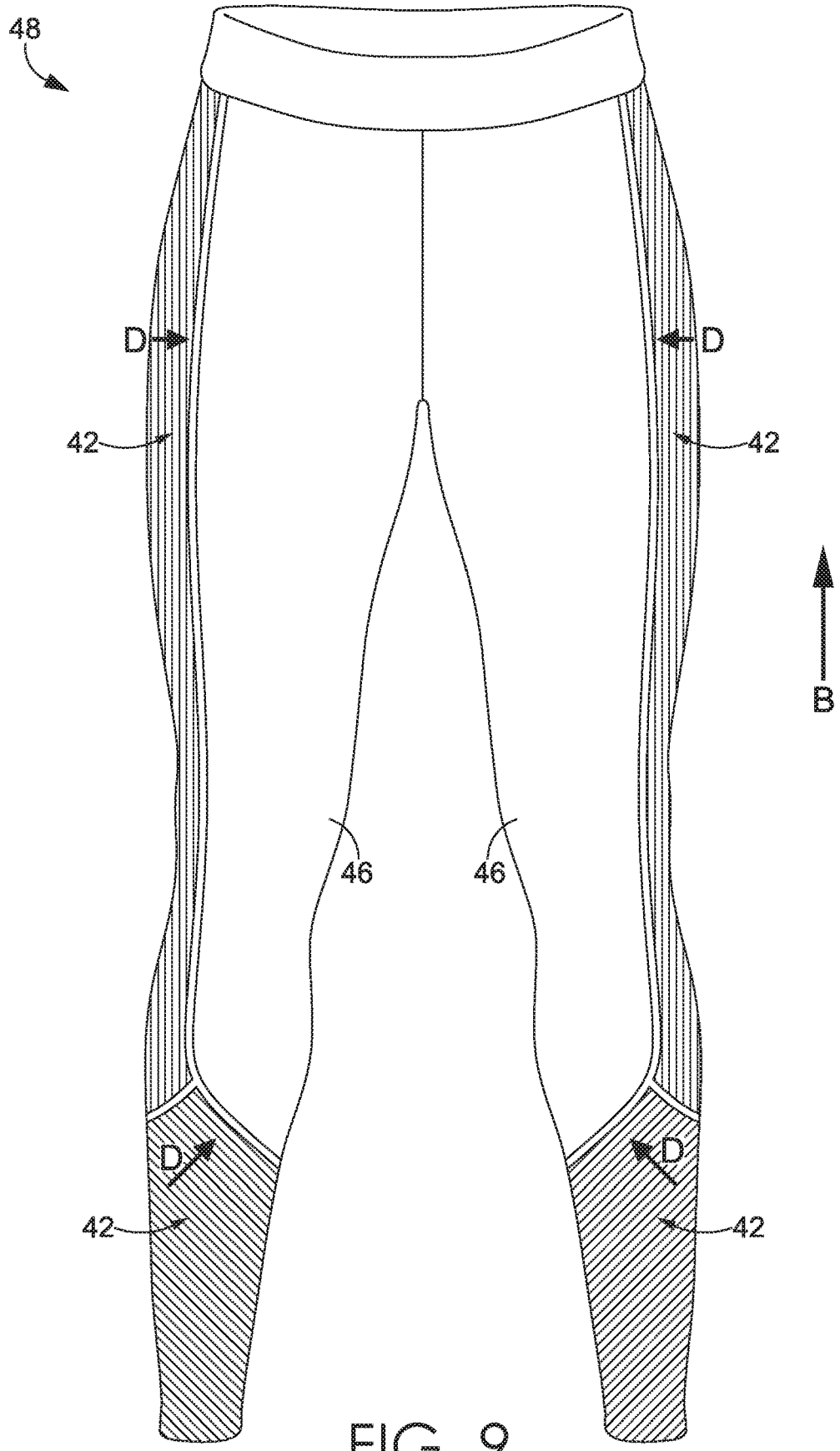
FIG. 9 illustrates a front elevation view of an exemplary garment comprising a lower body apparel item depicted in the as-worn position in accordance with aspects herein.
Figure 10:
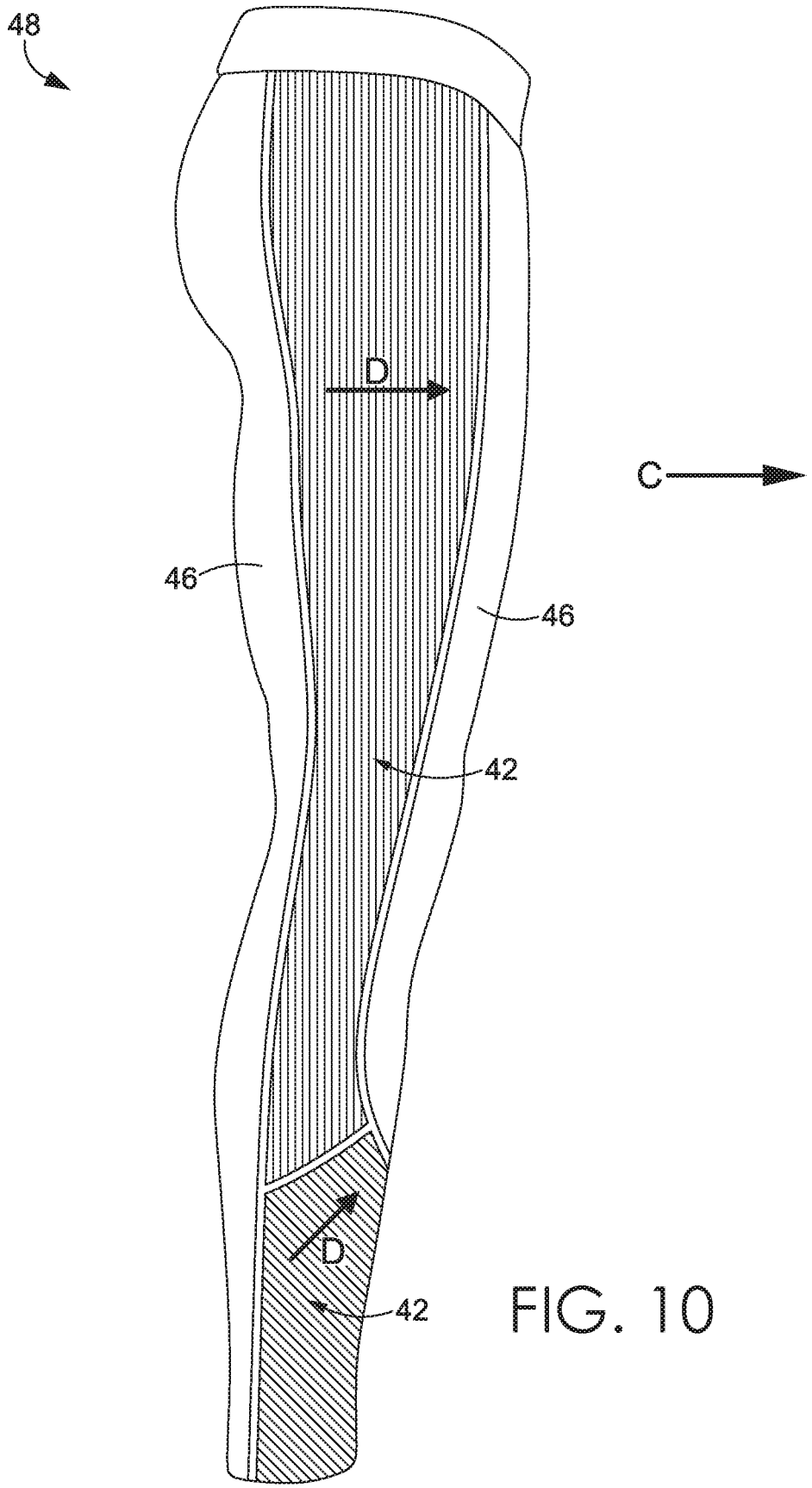
FIG. 10 illustrates a side elevation view of the exemplary garment comprising a lower body apparel item depicted in the as-worn position in accordance with aspects herein.

Referring to FIGS. 9 and 10, in some aspects the garment may comprise a lower torso apparel item 48. The lower torso apparel item 48 may comprise pants, shorts, or other garment adapted to cover a portion of the lower torso of a wearer when the garment is in the as-worn position. The lower torso apparel item 48 may comprise the drag inducing articles 42. The lower torso apparel item 48 may further comprise one or more additional panels 46.

The drag inducing articles 42 may be oriented in different directions from one another to induce drag forces based on a plurality of wearer movements. For example, some of the drag inducing articles 42 may be oriented to provide increased drag when the lower torso apparel item 48 is moved in a first direction B. A wearer may move, and consequently cause the lower torso apparel item 48 to move when in the as-worn position, in the first direction B when moving from a crouched position to a standing position (for example, when a sprinter begins a sprint) or when moving from a standing position to a leaping position (for example, when a basketball player leaps in the air). Similarly, some of the drag inducing articles 42 may be oriented to provide increased drag when the lower torso apparel item 48 is moved in a second direction C. A wearer may move, and consequently cause the lower torso item 48 to move when in the as-worn position, in the second direction C when engaging in ground locomotion (for example, when the wearer is running).

Figure 11:
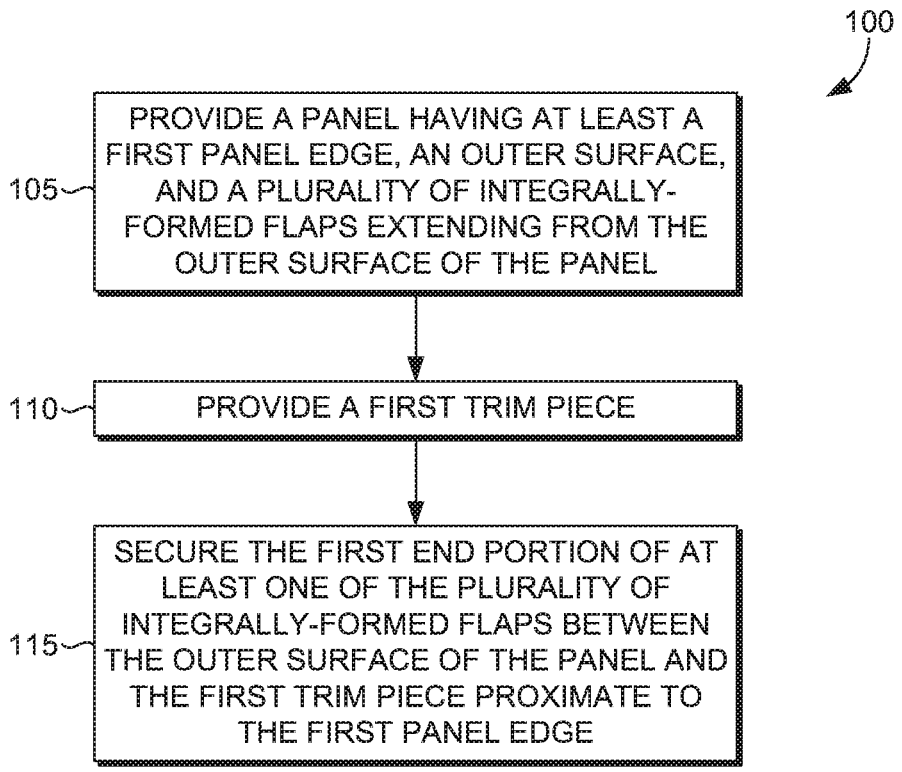
FIG. 11 depicts a flow diagram illustrating an exemplary method of manufacturing an article for providing fluid resistance when the article is moved through a fluid in accordance with aspects herein.

Referring to FIG. 11, a method 100 of manufacturing an article for providing fluid resistance when the article is moved through a fluid is provided. The method 100 comprises providing a panel having at least a first panel edge, an outer surface, and a plurality of integrally-formed flaps extending from the outer surface of the panel, as depicted in block 105. In some aspects, the plurality of integrally-formed flaps further comprises a first end portion located proximate to the first panel edge. At illustrated at block 110, the method 100 comprises providing a first trim piece. Further, the method 100 comprises securing the first end portion of at least one of the plurality of integrally-formed flaps between the outer surface of the panel and the trim piece proximate to the first panel edge, as depicted in block 115.

The method 100 may further comprise providing a second trim piece. Additionally, the method 100 may further comprise securing a second end portion of at least one of the plurality of integrally-formed flaps between the outer surface of the panel and the second trim piece proximate to a second panel edge.

From the foregoing, it will be seen that aspects described herein are well adapted to attain all the ends and objects hereinabove set forth together with other advantages which are obvious and which are inherent to the structure. It will be understood that certain features and subcombinations are of utility and may be employed without reference to other features and subcombinations. This is contemplated by and is within the scope of the claims. Since many possible aspects described herein may be made without departing from the scope thereof, it is to be understood that all matter herein set forth or shown in the accompanying drawings is to be interpreted as illustrative and not in a limiting sense.

What is claimed is:

1. An upper-body article comprising:

a front panel located on a torso portion of the upper-body article, the front panel having at least a front panel first edge, a front panel second edge, and a front panel outer surface, the front panel comprising a first plurality of integrally-formed flaps that extend from the front panel outer surface and longitudinally extend between the front panel first edge and the front panel second edge, wherein each flap of the first plurality of integrally-formed flaps includes a first flap edge and an opposite second flap edge, the second flap edge being movable away from the front panel outer surface;

a side panel located on the torso portion of the upper-body article and positioned adjacent to the front panel, the side panel having at least a side panel superior edge, a side panel inferior edge, and a side panel outer surface, the side panel comprising a second plurality of integrally-formed flaps that extend from the side panel outer surface and longitudinally extend between the side panel superior edge and the side panel inferior edge, wherein each of the second plurality of integrally-formed flaps includes a first flap edge and an opposite second flap edge; and a first trim piece affixed to the front panel proximate to the front panel first edge and securing a first end portion of at least one of the first plurality of integrally-formed flaps between the first trim piece and the front panel outer surface, the first trim piece extending vertically with respect to a neckline opening and a torso opening of the upper-body article;

wherein the first flap edge of each of the first plurality of integrally-formed flaps is oriented such that the first plurality of integrally-formed flaps form an acute angle with respect to the first trim piece, and wherein the first flap edge of each of the second plurality of integrally formed flaps is oriented parallel to the first trim piece such that the second plurality of integrally-formed flaps are parallel with respect to the first trim piece; and wherein the first plurality of integrally-formed flaps and the second plurality of integrally formed flaps are adjacent to the first trim piece, such that the first plurality of integrally-formed flaps and the second plurality of integrally-formed flaps are both located on the torso portion of the upper-body article.

2. The upper-body article of claim 1, wherein the first plurality of integrally-formed flaps extends from the first flap edge that extends along the front panel outer surface to the second flap edge.

3. The upper-body article of claim 2, wherein the second flap edge of a first integrally-formed flap of the first plurality of integrally-formed flaps overlaps the first flap edge of a second integrally-formed flap that is adjacent to the first integrally-formed flap.

4. The upper-body article of claim 2, wherein the first flap edge of each of the first plurality of integrally-formed flaps is offset from the first flap edge of other integrally-formed flaps.

5. The upper-body article of claim 4, wherein the first flap edge of each of the first plurality of integrally-formed flaps extends across the front panel outer surface in parallel with the other integrally-formed flaps.

6. The upper-body article of claim 4, wherein the first flap edge of each of the first plurality of integrally-formed flaps is concentrically aligned with the first flap edge of the other integrally-formed flaps.

7. The upper-body article of claim 1, wherein one or more air pockets that create drag are formed on the upper-body article between one or more pairs of adjacent flaps of the first plurality of integrally-formed flaps.

8. The upper-body article of claim 1, wherein the first trim piece comprises a zipper tape.

9. The upper-body article of claim 1, wherein the front panel first edge is opposite the front panel second edge.

10. The upper-body article of claim 1, wherein the front panel comprises at least one of:

a woven fabric; or a knit fabric.

11. A method of manufacturing an article comprising:

providing a front panel forming a torso portion of the article, the front panel comprising at least a front panel first edge, a front panel second edge, a front panel outer surface, and a first plurality of integrally-formed flaps extending from the front panel outer surface and longitudinally extending between the front panel first edge and the front panel second edge, wherein the first plurality of integrally-formed flaps further comprise a first end portion located proximate to the front panel first edge, wherein each flap of the first plurality of integrally-formed flaps includes a first flap edge and an opposite second flap edge, the second flap edge movable away from the front panel outer surface;

providing a side panel positioned adjacent to the front panel such that a portion of the side panel is located on the torso portion of the article, the side panel comprising at least a side panel superior edge, a side panel inferior edge, a side panel outer surface, and a second plurality of integrally-formed flaps extending from the side panel outer surface and longitudinally extending between the side panel superior edge and the side panel inferior edge, wherein each of the second plurality of integrally-formed flaps includes a first flap edge and an opposite second flap edge;

providing a first trim piece affixed to the front panel on the torso portion of the article; and securing the first end portion of at least one of the first plurality of integrally-formed flaps between the front panel outer surface and the first trim piece proximate to the front panel first edge;

wherein the first plurality of integrally-formed flaps form an acute angle with respect to the first trim piece, and wherein the second plurality of integrally-formed flaps are oriented parallel to the first trim piece, and further wherein the first plurality of integrally-formed flaps and the second plurality of integrally-formed flaps are adjacent to the first trim piece, such that the first plurality of integrally-formed flaps and the second plurality of integrally-formed flaps are both located on the torso portion of the article.

12. An upper-body garment comprising:

a front panel having a front panel outer surface and at least a front panel first edge and a front panel second edge, the front panel adapted to cover a right front portion of a wearer's torso when the upper-body garment is in an as-worn position;

a side panel positioned adjacent to the front panel, the side panel adapted to cover a side portion of the wearer's torso when the upper-body garment is in the as-worn position, the side panel and having a side panel outer surface and at least a side panel superior edge and a side panel inferior edge;

a first plurality of overlapping flaps formed integral to the front panel and positioned on the front panel outer surface between the front panel first edge and the front panel second edge, wherein each of the first plurality of overlapping flaps includes a first integrated edge along which the first plurality of overlapping flaps extend distally away from the front panel outer surface and an opposite second edge that overlaps the first integrated edge of an adjacent flap of the first plurality of overlapping flaps, and wherein each of the first integrated edges are offset from one another;

a second plurality of overlapping flaps formed integral to the side panel and positioned on the side panel outer surface between the side panel superior edge and the side panel inferior edge, wherein each of the second plurality of overlapping flaps includes a second integrated edge along which the second plurality of overlapping flaps extend distally away from the side panel outer surface, and wherein each of the second integrated edges are offset from one another; and a first trim piece affixed to the front panel along the front panel first edge and securing a first end portion of at least one of the first plurality of overlapping flaps between the first trim piece and the front panel outer surface; and wherein the first integrated edges of the first plurality of overlapping flaps form an acute angle with respect to the first trim piece, and wherein the first integrated edges of the second plurality of overlapping flaps are parallel with respect to the first trim piece, and further wherein the first plurality of overlapping flaps and the second plurality overlapping flaps are adjacent to the first trim piece, such that the first plurality of overlapping flaps and the second plurality of overlapping flaps are both located on the torso portion of the upper-body article.

13. The upper-body garment of claim 12, wherein the front panel and the first trim piece together comprise a first drag inducing article, and further wherein the side panel and the first trim piece together comprise a second drag inducing article.

14. The upper-body garment of claim 13, wherein the first drag inducing article is oriented relative to the upper-body garment to induce drag based upon motion in a first direction, and further wherein the second drag inducing article is oriented relative to the upper-body garment to induce drag based upon motion in a second direction.

* * * * *